US006942429B1

(12) United States Patent
Beck, III et al.

(10) Patent No.: US 6,942,429 B1
(45) Date of Patent: Sep. 13, 2005

(54) POST-STRESSED PILE

(76) Inventors: August H. Beck, III, 10 Hearthwood, San Antonio, TX (US) 78248; Philip G. King, 4643 Green Willow Woods, San Antonio, TX (US) 78249

( * ) Notice: Subject to any disclaimer, the term of this patent is extended or adjusted under 35 U.S.C. 154(b) by 0 days.

(21) Appl. No.: 10/818,084

(22) Filed: Apr. 5, 2004

Related U.S. Application Data

(62) Division of application No. 10/288,168, filed on Nov. 5, 2002.

(51) Int. Cl.[7] ..... E02D 15/04; E02D 5/36
(52) U.S. Cl. ..... 405/236; 405/248; 405/256
(58) Field of Search ..... 405/231–233, 405/236, 239, 248, 249, 256

(56) References Cited

U.S. PATENT DOCUMENTS

| | | | | |
|---|---|---|---|---|
| 3,503,254 | A | 3/1970 | Menard | |
| 3,633,408 | A | 1/1972 | Johnston, Jr. | |
| 3,772,911 | A | 11/1973 | Ruppeneit et al. | 73/88 |
| 3,793,844 | A | 2/1974 | Chelminski | 61/63 |
| 4,315,429 | A | 2/1982 | Morozov et al. | 73/84 |
| 4,458,525 | A | 7/1984 | Lutenegger et al. | 73/84 |
| 4,483,197 | A | 11/1984 | Kellner | 73/784 |
| 4,598,591 | A | 7/1986 | Baud | 73/784 |
| 4,614,110 | A | 9/1986 | Osterberg | 73/84 |
| 4,662,213 | A | 5/1987 | Handy et al. | 73/37 |
| 4,663,977 | A | 5/1987 | Vander Heyden | 73/861.27 |
| 4,722,407 | A | 2/1988 | Gindy et al. | 177/50 |
| 4,906,141 | A | 3/1990 | Massarsch | |
| 5,185,595 | A | 2/1993 | Friesen | 340/690 |
| 5,259,240 | A | 11/1993 | Raines et al. | 73/84 |
| 5,319,959 | A | 6/1994 | Cooper et al. | 73/84 |
| 5,377,548 | A | 1/1995 | Ballivy | 73/768 |
| 5,576,494 | A | 11/1996 | Osterberg | 73/784 |
| 5,739,435 | A | 4/1998 | Sacks | 73/784 |
| 5,823,718 | A | 10/1998 | Du Plessis | 405/288 |
| 6,371,698 | B1 | 4/2002 | Beck, III et al. | |

FOREIGN PATENT DOCUMENTS

| | | | |
|---|---|---|---|
| DE | 150089 | 8/1981 | E02D 33/00 |
| GB | 1413160 | 11/1975 | G01N 33/24 |

OTHER PUBLICATIONS

"New Technological and Design Developments in Deep Foundations", Proceedings of Sessions of Geo-Denver 2000, Geotechnical Special Publication No. 100.
"Enhancing the Performance of Large Diameter Piles by Grouting", Ground Engineering Jul. 1986, ibid May 1986.

(Continued)

*Primary Examiner*—Frederick L. Lagman
(74) *Attorney, Agent, or Firm*—Akin Gump Strauss Hauer & Feld, LLP

(57) ABSTRACT

A structural pile assembly includes a driven pile and pressurized grout contained beneath the pile so as to exert an upward force on the pile. An enclosure, such as a bladder or bellows, is filled with grout from a reservoir via a conduit which preferably extends axially along the length of the pile and is left in place after the grout hardens. A pressure gauge measures the pressure of the grout within the enclosure, permitting the direct measurement of end bearing and side bearing capacities of the resulting pile assembly. The load bearing capacity of the pile is enhanced by the pressurized grout, and is preferably at least twice the end bearing capacity of an unpressurized pile.

11 Claims, 7 Drawing Sheets

OTHER PUBLICATIONS

"Stage Grouting Preloading of Large Piles on Sand", Proceedings of the Eighth International Conference on Soil Mechanics and Foundation Engineering.

"Improvement of Ground", Edited by H.G. Rathmayer & K.H.O. Saari, Proceedings of the Eighth European Conference on Soil Mechanics and Foundation Engineering.

"Enhancement of Calsson Capacity by Micro=Fine Cement Grouting—A Recent Case History", by D.A. Bruce, P.J. Nufer and R.E. Triplett.

"The Improvement of Pile Performance by Base Grouting", W.G.K. Fleming.

"Pressure Grouting Drilled Shaft Tips: Full-Scale Research Investigation for Silty and Shelly Sands", Steven D. Dapp and Gray Mullins.

"Proceedings", International Conference on Design and Construction of Deep Foundations, vol. 1, Dec. 1994.

"O-Cell Testing Case Histories Demonstrate the Importance of Bored Pile (Drilled Shaft) Construction Technique", Fourth International Conference on Case Histories in Geotechnical Engineering, Mar. 1998.

"Foundation with Grouted Base Piles Misr International Tower, Cairo, Egypt" Bauer.

"Foundation with Grouted Base Piles United States Embassy, Cairo, Egypt" Bauer.

"Foundation with Grouted Base Piles Steel Plant Jubail/Saudi Arabia" Bauer.

"Foundation with Grouted Base Piles Jeddah-Mecca-Expressway" Bauer.

POST-STRESSED PILE

RELATED PATENTS

This application is related to our U.S. Pat. No. 6,371,698, issued Apr. 16, 2002, entitled "Post Stressed Pier."

RELATED APPLICATION

This application is a divisional of U.S. patent application Ser. No. 10/288,168 filed Nov. 5, 2002, entitled "Post-Stressed Pile."

FIELD OF THE INVENTION

The invention relates generally to techniques for increasing the load bearing capacity of structural foundation piers and piles, and more particularly to the use of structures or devices placed beneath or within piers and piles to enhance load bearing.

BACKGROUND OF THE INVENTION

Drilled shafts, or piers, are often used in the deep foundation industry because they provide an economical alternative to other types of deep foundations. Drilled piers are typically formed by excavating a cylindrical borehole in the ground and then placing reinforcing steel and fluid concrete in the borehole. The excavation may be assisted by the use of drilling fluids, casements or the like. When the concrete hardens, a structural pier suitable for load bearing results. These piers may be several feet in diameter and 50 feet or more deep. They are typically designed to support axial and tensile compressive loads.

Alternatively, driven piles may be used as foundation elements. Particularly in soft soils, where shaft excavation may be difficult due to caving of the soil, driving piling has long been a suitable alternative to drilled-shaft piers. Conventionally, a pre-formed or pre-cast element is driven into the soil using either a high-speed vibratory driving tool or large percussive hammers. Typically, driven piles may be solid pre-cast concrete; solid steel beam; or steel pipe piling. A wide variety of materials and shapes for driven piling is known to those skilled in the art, including tapered piles, I-beams, and the like.

A finished structural foundation element such as a pier or pile has an axial load bearing capacity which is conventionally characterized by components of end bearing ($q_b$) and side bearing, which is a function of skin friction ($f_s$). Loads applied at the top end of the element are transmitted to the sidewalls of the element and to the bottom of the element. The end bearing capacity is a measure of the maximum load that can be supported there, and it will depend on numerous factors including the diameter of the element and the composition of the geomaterial (soil, rock, etc.) at the bottom of the shaft. The side bearing capacity is a measure of the amount of load capable of being borne by the skin friction developed between the side of the pier/pile and the geomaterial. It depends on numerous factors, including the composition of the foundation element and the geomaterial forming the side of the element, which may vary with length (depth). The sum of the end bearing and side bearing capacities generally represents the total load that can be supported by the element without sinking or slippage, which could cause destructive movements for a finished building or bridge atop the foundation.

Although it is desirable to know the maximum end bearing and side bearing for a particular pier or driven pile, it is difficult to make such measurements with a high degree of confidence. Foundation engineering principles account for these difficulties by assigning end bearing and load bearing capacities to a foundation element based on its diameter and depth, the geomaterial at the end of the element and along its side, and other factors. A safety factor is then typically applied to the calculated end bearing and side bearing capacities. These safety factors are chosen to account for the large number of unknown factors that may adversely affect side bearing and end bearing, including geomaterial stress states and properties, borehole roughness generated by the drilling process, geomaterial degradation at the borehole-shaft interface during drilling, length of time the borehole remains open prior to the placement of concrete, residual effects of drilling fluids, borehole wall stresses produced by concrete placement, and other construction-related details. For example, it is common to apply a safety factor of 2 to the side bearing so as to reduce by half the amount calculated to be borne by skin friction. Likewise, a safety factor of 3 is often applied to the calculated end bearing capacity, reflecting the foregoing design uncertainties and others.

The use of safety factors, although judiciously accounting for many of the uncertainties in drilled shaft pier construction and driving piling, often results in such foundation elements being assigned safe load capacities that are too conservative. To compensate, builders construct larger, deeper, and/or more elements than are necessary to safely support a structural load, unnecessarily increasing the time, effort and expense of constructing a suitable foundation.

As a partial solution, it has been known to directly measure the end bearing capacity and skin friction of a drilled-shaft pier. Osterberg (U.S. Pat. No. 4,614,110) discloses a parallel-plate bellows placed in the bottom of the shaft before a concrete pier is poured. The bellows are pressured up with fluid communicated through a pipe coaxial with the pier. Skin friction is determined by measuring the vertical displacement of the pier (corresponding to the movement of the upper bellows plate) as a function of pressure in the bellows. Likewise, end bearing is determined by measuring pressure against the downward movement of the lower bellows plate, as indicated by a rod affixed thereto and extending above the surface through the fluid pipe. Upon completion of the load test, the bellows are depressurized. The bellows may then be abandoned or filled with cement grout, and in the latter case becomes in essence an extension of the lower end of the pier.

The method of Osterberg most often serves only the purpose of load testing. In practice, most often a drilled shaft employing the "Osterberg cell" is abandoned after testing in favor of nearby shafts that do not contain a non-functioning testing cell at their base. The method of Osterberg also is limited to use with drilled shaft piers, because with driven piling, there is no open shaft into which the "Osterberg call" may be placed so that it is positioned beneath the foundation element of interest.

Other methods have been developed for enhancing the load bearing capacity of drilled shaft piers by permanently pressuring up the base, but they lack the testing capabilities of the Osterberg cell. For example, it is known to inject pressurized cement grout under the base of concrete piers to enhance load bearing. In post-grouting, the pressurized grout increases end bearing, but neither the resultant increase nor the absolute end bearing capacity can be determined from the pressure or volume of the grout. In some soils, skin friction may also be increased by allowing the pressurized grout to flow up around the sides of the shaft, but this side bearing capacity, too, is not determinable with this technique.

SUMMARY OF THE INVENTION

It is therefore desirable to enhance the load bearing capacity of a drilled shaft foundation pier or a driven foundation pile in a manner that permits direct measurement of the resultant end bearing and side bearing capacities of the pier or pile.

Accordingly, an object of the present invention is to provide a simple and convenient technique for directly measuring the end bearing and side bearing capacities of a foundation pier or pile.

Another object of the present invention is to allow a reduction in the safety factors in determining the load bearing capacity of a pier or pile.

Another object of the present invention is to increase the end bearing and side bearing capacities of a foundation pier or pile in a known amount.

Another object of the present invention is to use the same device to aid in measuring the load bearing capacity of a pier or pile, and increase its load bearing capacity.

In satisfaction of these and other objects, the invention preferably includes a bladder, cell, or other supporting enclosure placed at the base or within the length of a pier for receiving pressurized grout. The enclosure is filled with pressurized grout to stress the base of the pier. The known pressure of the grout can be used to calculate end bearing and side bearing capacities of the pier. Upon hardening under pressure, the supporting enclosure permanently contributes to increased end bearing and side bearing in a known amount. In the resulting pier assembly, the supporting enclosure in essence becomes an extension forming the lower end of the pier. The post-base-stressed pier assembly has end bearing and side bearing capacities that are enhanced, and are determinable by direct measurement, thus reducing the safety factor used in the pier load bearing capacity calculation.

The invention may take the form of a post-stressed driven pile where driven piling is selected as the foundation element instead of drilled-shaft piers. Even in this form, the invention preferably includes a bladder, cell, or other supporting enclosure placed at the base or within the length of a pile prior to driving the pile into the ground. After the pile is driven into the ground, the enclosure is filled with pressurized grout to stress the base of the pier. As with a pier, the known pressure of the grout can be used to calculate end bearing and side bearing capacities of the pile, and the supporting enclosure permanently contributes to increased end bearing and side bearing in a known amount. The post-stressed pile assembly has end bearing and side bearing capacities that are enhanced, and are determinable by direct measurement, thus reducing the safety factor used in the pile load bearing capacity calculation.

In one embodiment, the supporting enclosure for either a pier or a driven pile is a bladder made of a strong material such as thick rubber. The bladder is filled with pressurized grout via a conduit extending axially down the pier or pile to be post-base-stressed. The grout hardens under pressure, and the actual end bearing capacity is calculated from the pressure and the area of the bottom of the shaft (or the bottom of the pile, in the case of driven piles). Pressurization of the bladder pushes upward on the foundation element, resulting in additional opposing skin friction in a known amount. Subsequent downward load is opposed by the end bearing, the original skin friction, and the additional skin friction created by the pressurization of the bladder. This additional skin friction is closely related to the end bearing capacity. Accordingly the post-base-stressed element advantageously has at least twice the known overall load bearing capacity of an unstressed element.

In another embodiment, the supporting structure for either a pier or a driven pile comprises hard plates forming opposite ends of bellows. The regular geometry of such plates ensures more uniform application of pressure from the grout against the lower end of the pier or pile and the soil interface at the lower end of the bellows.

In yet another embodiment, the post-base-stressed foundation element assembly need not be formed with an enclosure, but may simply rely on the natural boundaries provided by the soil interface and the lower end of the pier or pile to receive and contain the pressurized grout.

In yet another embodiment, the supporting assembly is placed within the length of the concrete pier to be post-base-stressed. In one such embodiment, a distal pier portion forming a portion of the length of the pier may be formed first, and the supporting assembly placed thereon before the remainder of the length of the pier is formed. The supporting assembly may be either the bladder or bellows structure described above, or post-stressing may occur by injection of grout into an enclosure defined by the side of the shaft and the previously-formed pier portion in the distal end of the shaft.

BRIEF DESCRIPTION OF THE DRAWINGS

The present invention is more easily understood with reference to the drawings, in which.

DETAILED DESCRIPTION OF THE PREFERRED EMBODIMENTS

Figure 1:
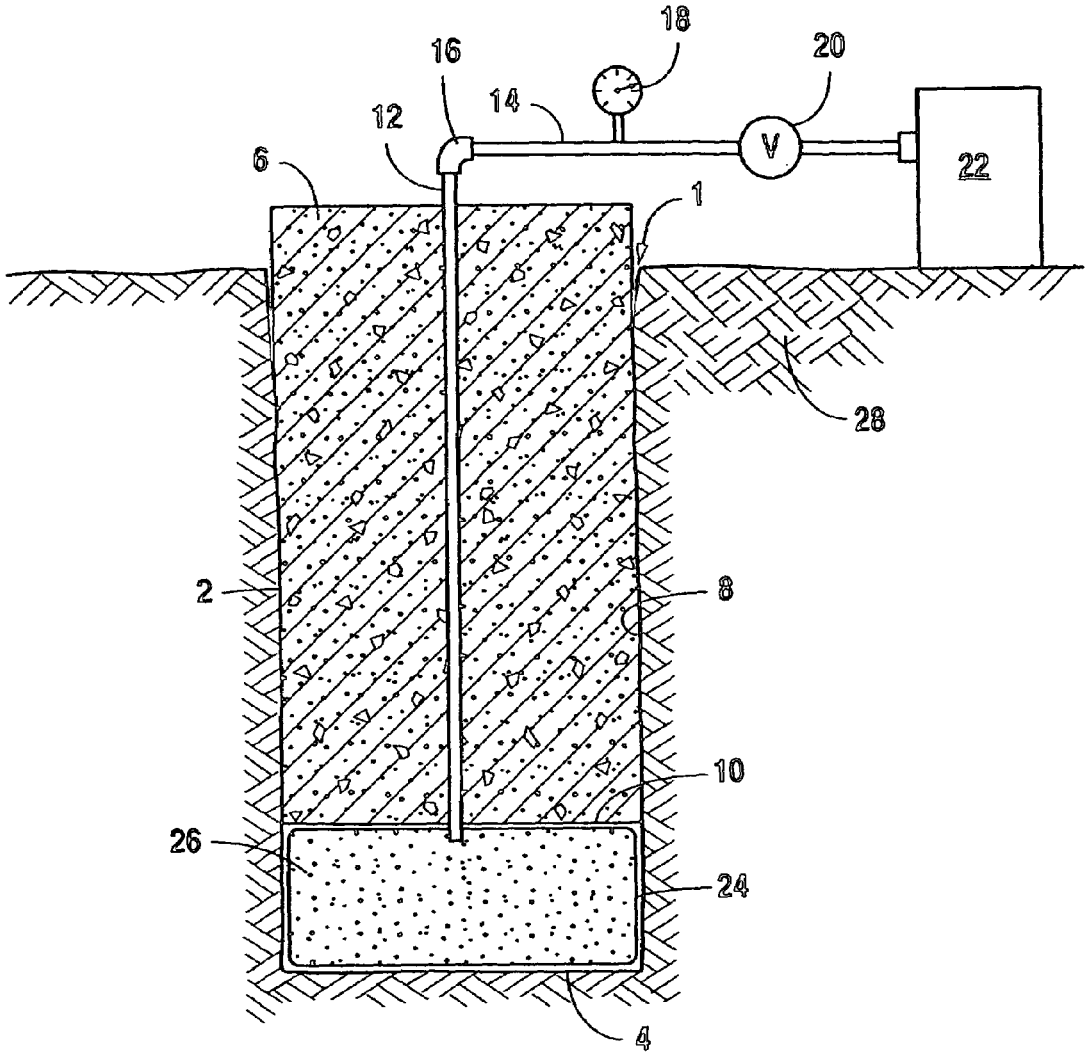
FIG. 1 is a cross-sectional view of a post-base-stressed pier assembly and apparatus for injecting pressurized grout into a supporting bladder thereof.

Referring in more detail to the drawings, there is shown in FIG. 1 apparatus for post-base stressing a concrete pier 6. Any suitable technique for producing a shaft 1 having a shaft wall 2 and a shaft floor 4 may be employed to commence construction of the pier in earthen material 28. Pier 6 is preferably made of cementitious material such as concrete, and may be formed by conventional techniques, which include the use of steel reinforcing bars or cages to increase the strength of the pier under the influence of torsional forces or tensile loading. Shaft wall 2 exerts skin friction against pier wall 8 commensurate with the weight of the pier and any load placed on it.

Enclosure 24 is placed in the lower end of the shaft 1 before the pier 6 is poured. Enclosure 24 may be any structure capable of containing pressurized grout, and is preferably a thick rubber bladder or cell. After placement of enclosure 24, pier 6, which is preferably cylindrical, is formed in the usual manner. Enclosure 24 is adapted to receive pressurized grout 26 via conduit 12, which is preferably a pipe extending coaxially along the length of pier 6. Conduit 12 may be coupled to enclosure 24 in a variety of ways known to those skilled in the art. Further, it will be apparent to those skilled in the art that pressurized fluid grout may be transmitted to enclosure 6 in a variety of ways, for example, by a conduit extending down the side of the shaft.

Conduit 26 is in fluid communication with reservoir 22 containing fluid grout. In simple fashion, upon opening of valve 20, grout may be pumped from reservoir 22 through a lateral 14, which is joined by elbow 16 to conduit 12. The pressure of grout 26 within enclosure 24 is measured at the surface by a pressure gauge 18. Fluid grout is pumped into enclosure 6 until it fills the cavity bounded by shaft wall 2, shaft floor 4 and lower end 10 of pier 6, whereupon further pumping requires significantly greater pressures due to the weight of pier 6, the skin friction between shaft wall 2 and pier wall 8, and the relative incompressibility of the fluid grout.

Injection of grout under pressure creates an upward force exerted by enclosure 24 against pier 6 at its lower end 10. Injection continues until the pressure indicated by gauge 18 reaches a predetermined threshold or until some other criterion is reached. The maximum load bearing will ordinarily be obtained if pressurization continues until the onset of gross upward movement of pier 6 in the shaft, indicating incipient ejectment of the pier from the shaft. At the desired point, valve 20 is closed and the quiescent pressure within enclosure is obtained by gauge 18.

Figure 5:
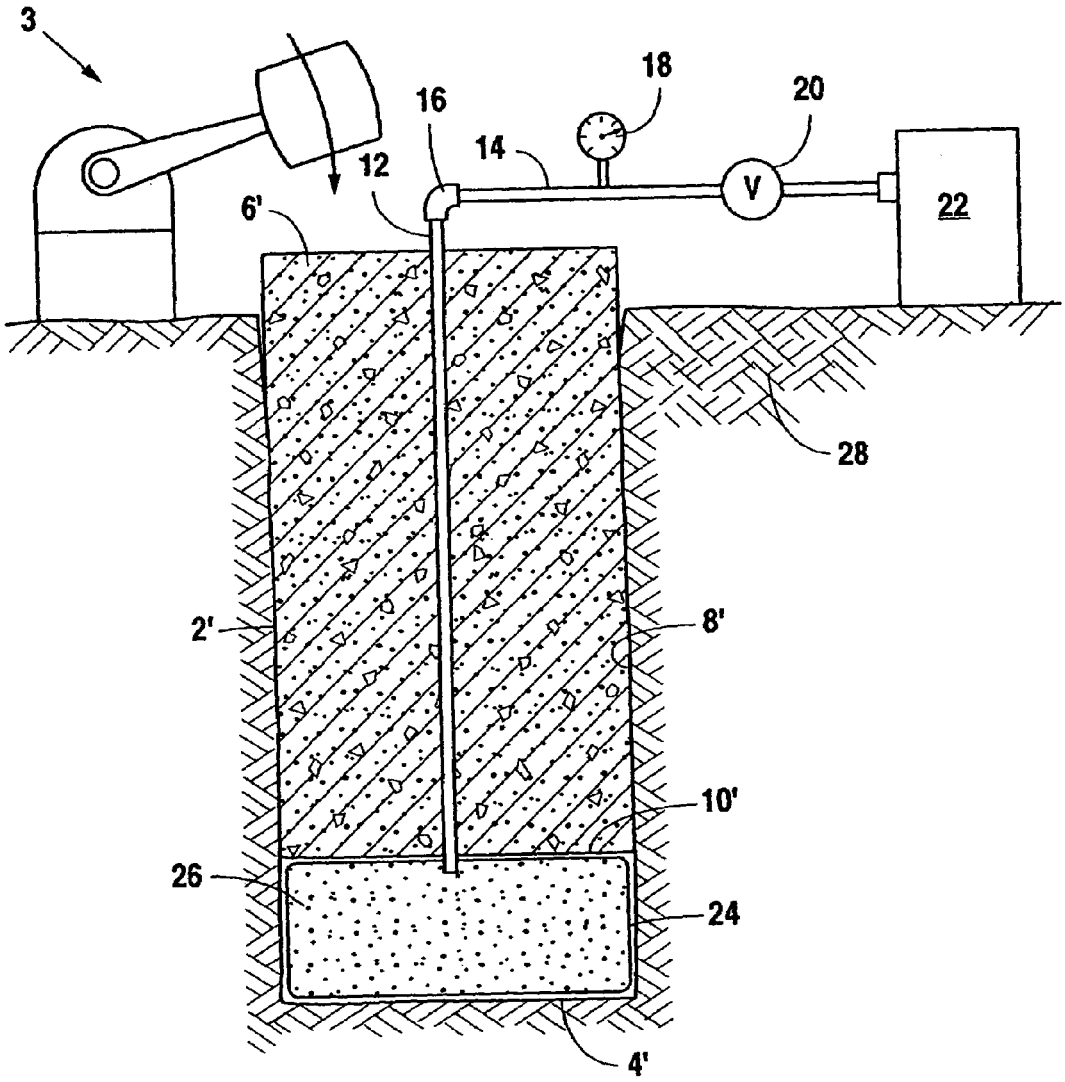
FIG. 5 is a cross-sectional view of the driven pile assembly according to the present invention and apparatus for injecting pressurized grout into a supporting bladder thereof.

Direct measurement of the end bearing capacity of the resulting post-base-stressed pier assembly is thereby obtained from the quiescent pressure and the area of shaft floor 4. In a similar manner, the side bearing capacity is directly measured from the quiescent pressure and the area of lower end 10 of the pier. Advantageously, the skin friction exerts a downward force on the post-base-stressed pier to resist the tendency of the pier to be ejected out of the borehole. A load placed on the pier must overcome this skin friction before returning the pier to its initial state, wherein the skin friction exerts an upward force in reaction to the weight of the pier itself. The pier 6 enjoys the benefit of the same skin friction, whether exerted upward or downward against the pier. The post-base-stressing of the pier therefore results in an increase in side bearing capacity in an amount corresponding to the pressurization of the bladder. In addition, because direct measurements of end bearing and side bearing are made, reduced safety factors can be employed. Once the necessary pressure measurements are made, pressurized grout 26 is allowed to harden so that enclosure 24 forms a permanent pressurizing extension of pier 6.

Where it is desired to employ driven piling, instead of piers formed in drilled shafts, FIG. 5 illustrates the construction of such a post-base-stressed driven pile in a manner similar to that described for FIG. 1. In this embodiment, the foundation element is a driven pile 6', which is illustrated as a concrete cylinder. In practice, the material and shape are a matter of design choice based on criteria known to those skilled in the art, such as soil type and conditions, size of load, and the like. Pile 6' is driven into the soil by driving mechanism 3, which may be a pneumatic hammer or any other driving apparatus known to those skilled in the art. Prior to driving the pile 6' into the soil, it is pre-fitted or pre-formed to retain grout conduit 12, and grout enclosure 24 is secured proximate the lower end 10' of the pile. Driving action from the driving mechanism 3 pushes pile 6' into the ground, creating vertical soil surface 2' adjacent pile wall 8' and lower soil interface 4' adjacent enclosure 24. Enclosure 24 is preferably constructed of material sufficiently thick and tough to resist puncturing or tearing as it is driven downward with pile 6'. Once the driven pile and grout enclosure are in place, grout filling and hardening under pressure proceeds as described with reference to FIG. 1, with corresponding advantages and benefits as described above.

Figure 2:
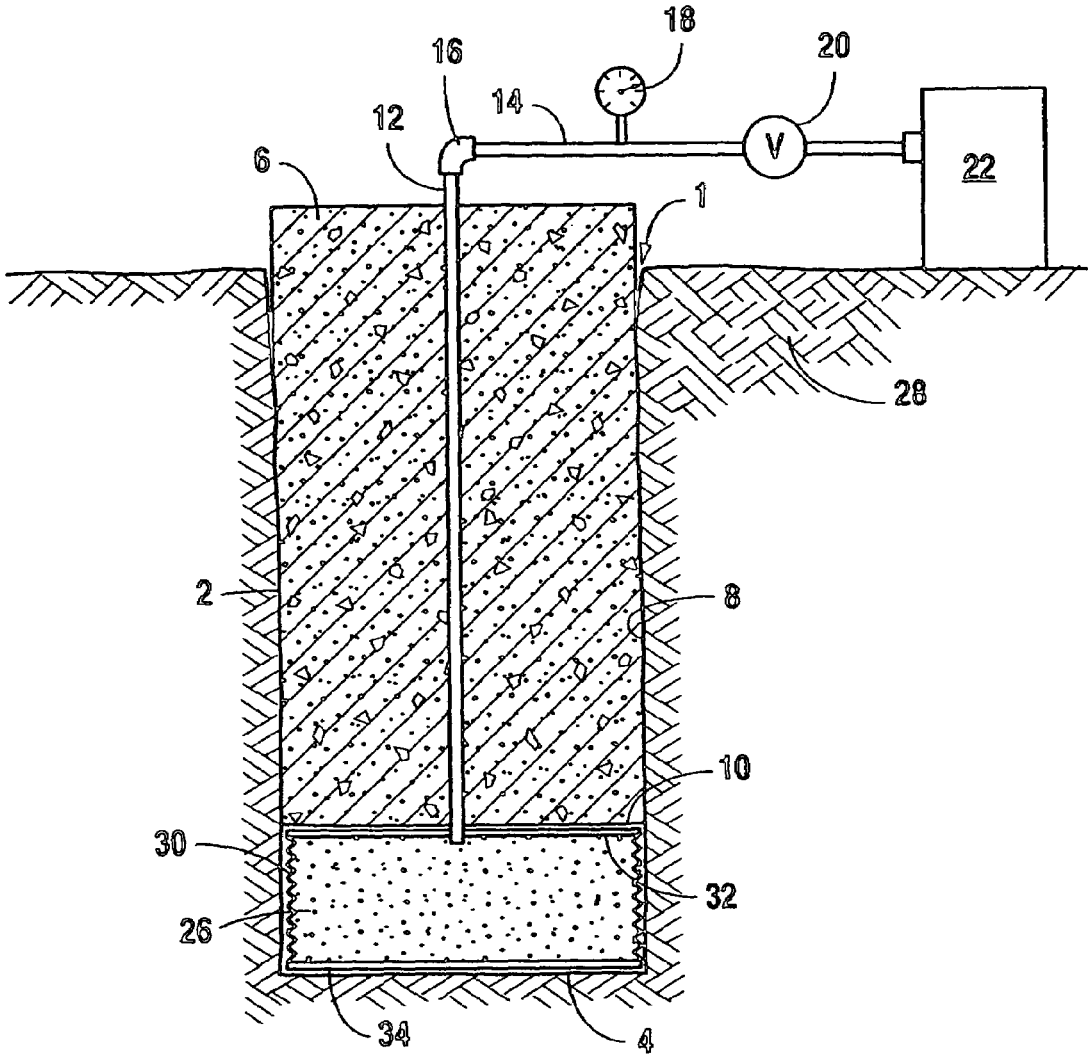
FIG. 2 is a cross-sectional view of a post-base-stressed pier employing bellows apparatus to stress the pier.

Another embodiment is shown in FIG. 2, wherein the grout enclosure comprises bellows 30 including hard upper plate 32 and lower plate 34. Plates 32 and 34 are preferably steel disks, but may be made from any sufficiently hard material. Upper plate 32 is adapted to receive conduit 12. Bellows 30 ensure that the enclosure fills substantially all of the cavity under the pier by minimizing the risk of folding or gathering that may occur with a rubber bladder. Likewise, bellows 30 provide more uniform pressure application at the shaft floor 4 and the lower end 10 of pier 6.

Figure 6:
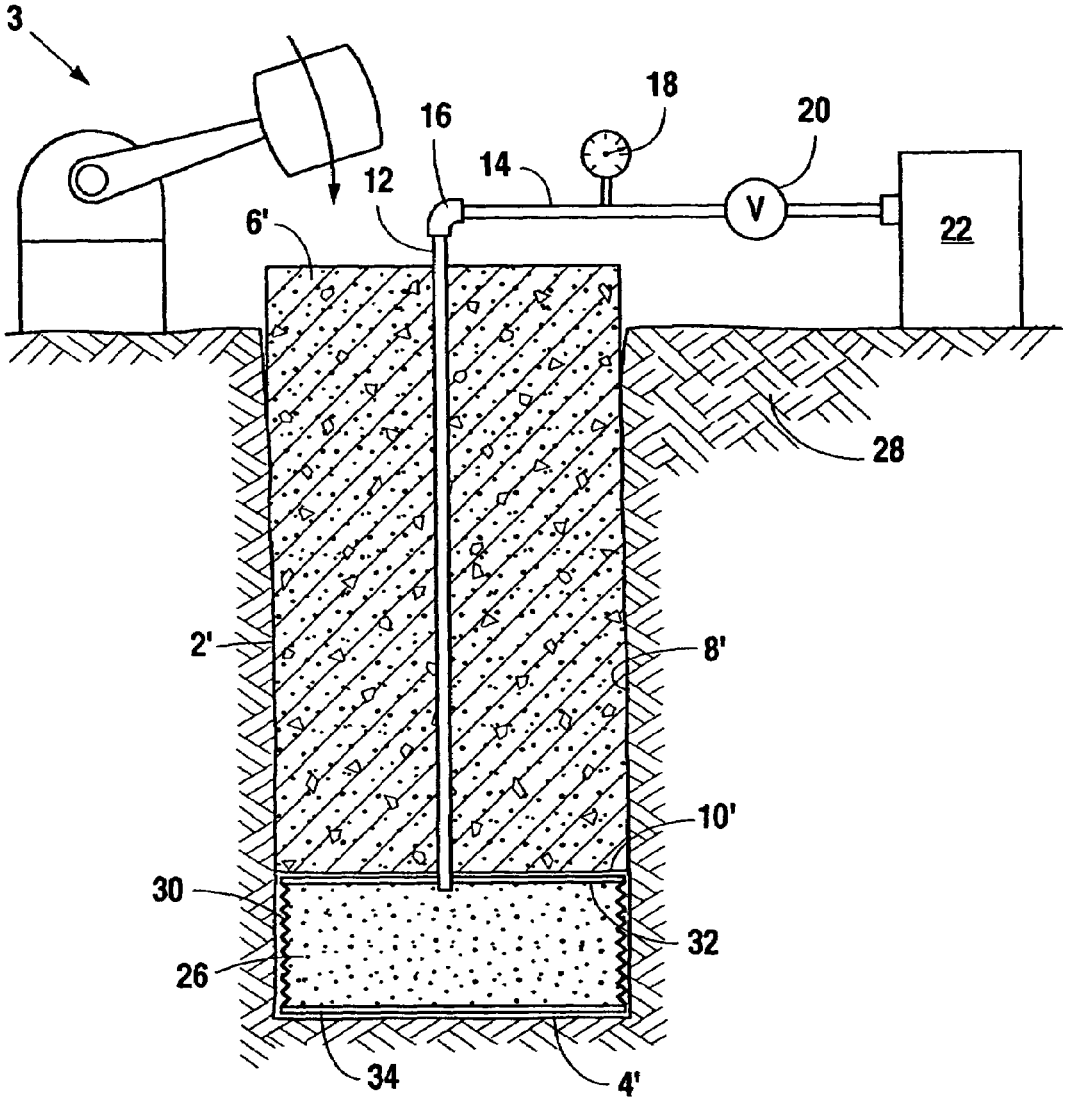
FIG. 6 is a cross-sectional view of an embodiment of the invention employing bellows apparatus to stress the pile.

The use of a metallic-plate bellows 30 is particularly suited to an embodiment employing driven piling rather than a cast-in-place pier, as shown in FIG. 6. Bellows 30 directly applies the driving force to lower soil interface 4'. Rigid plates 32 and 34, if constructed of metal, may be better adapted to resist damage from driving action than an enclosure made of rubber or other easily deformable material. Other than the use of bellows 30 in lieu of enclosure 34, the construction and use of post-stressed driven pile 6' is as described above with respect to FIG. 5.

Figure 3:
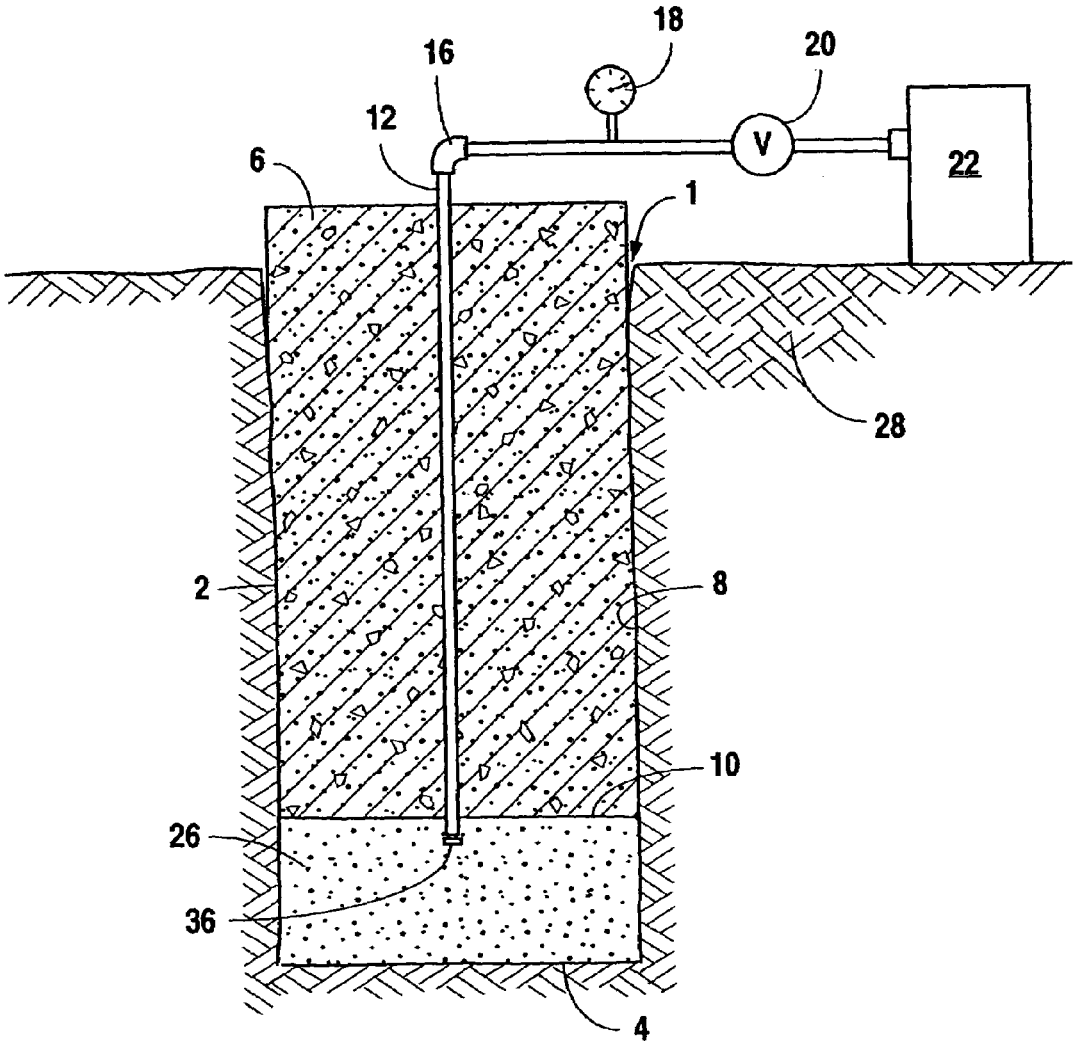
FIG. 3 is a cross-sectional view of a post-base-stressed pier in which the shaft and concrete pier portion contain the pressurized grout of the invention.

FIG. 3 shows another embodiment of the post-stressed pier assembly in which the pressurized grout 26 is not contained by a structural enclosure such as a bladder or bellows. In suitable hard earthen material 28, such as rock, shaft wall 2 and shaft floor 4 may be used to contain the pressurized grout beneath lower end 10 of pier 6. In this embodiment, conduit 12 is lowered into shaft 1 without an attached enclosure. A cage or other suitable apparatus may be employed to position conduit 12 and hold it in place while concrete pier 6 is poured. Snug-fitting blow-out plug 36 ensures that fluid concrete poured for the pier will not enter the conduit 12 in advance of the pressurized grout and cause blockage. Plug 36 is ejected when pressurized grout is forced through conduit 12 after pier 6 hardens. The hardness of earthen material 28 prevents pressurized grout 26 from being forced substantially upward alongside pier wall 8. The post-base-stressed pier is thus formed by concrete pier 6 and hardened pressurized grout 26 contained by the shaft wall and floor. Pressurized grout 26 exerts an upward force against pier 6 at its lower end 10, in a manner similar to the enclosure of FIGS. 1 and 2.

Figure 7:
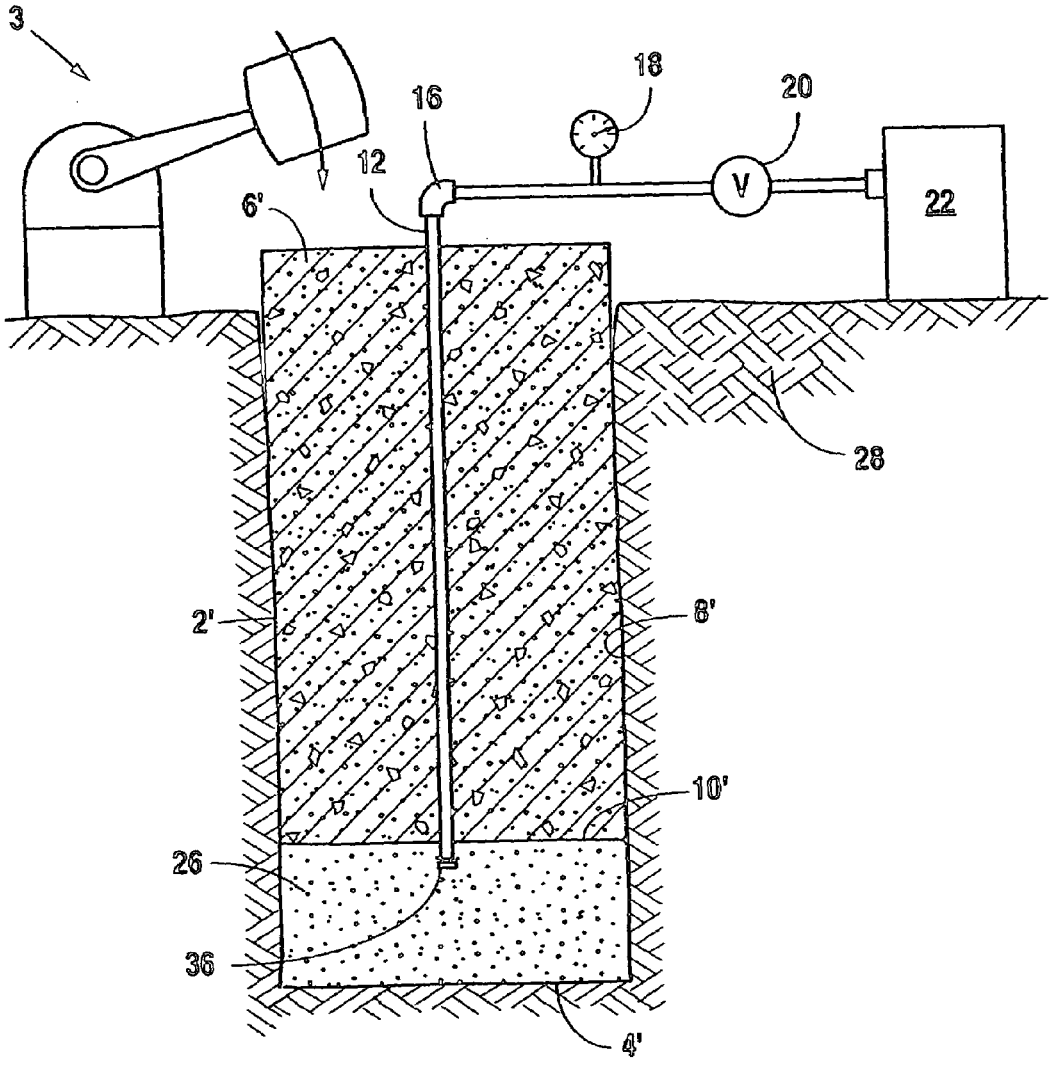
FIG. 7 is a cross-sectional view of another embodiment in which the lower portion of the driven pile and its soil interface contain the pressurized grout of the invention.

In an analogous manner, post-stressing a driven pile without a bladder or defined enclosure may be accomplished, as shown in FIG. 7. In this embodiment, driven pile 6' is pre-formed or pre-fitted with grout conduit 12, which terminates proximate the lower end 10' of the pile. If desired, a blow-out plug 36 is employed to keep conduit 12 clear during pile driving action. As with the pier described above with reference to FIG. 3, plug 36 is ejected when pressurized grout is forced through conduit 12. Earthen material 28 is typically relatively loose soil where driven piling is employed. Even so, the earthen material 28 functions to contain the pressurized grout generally between the lower soil surface 4' and the lower end 10' of pile 6'. The post-base-stressed pile assembly is thus formed by pile 6' and hardened pressurized grout 26 contained therebeneath.

Figure 4:
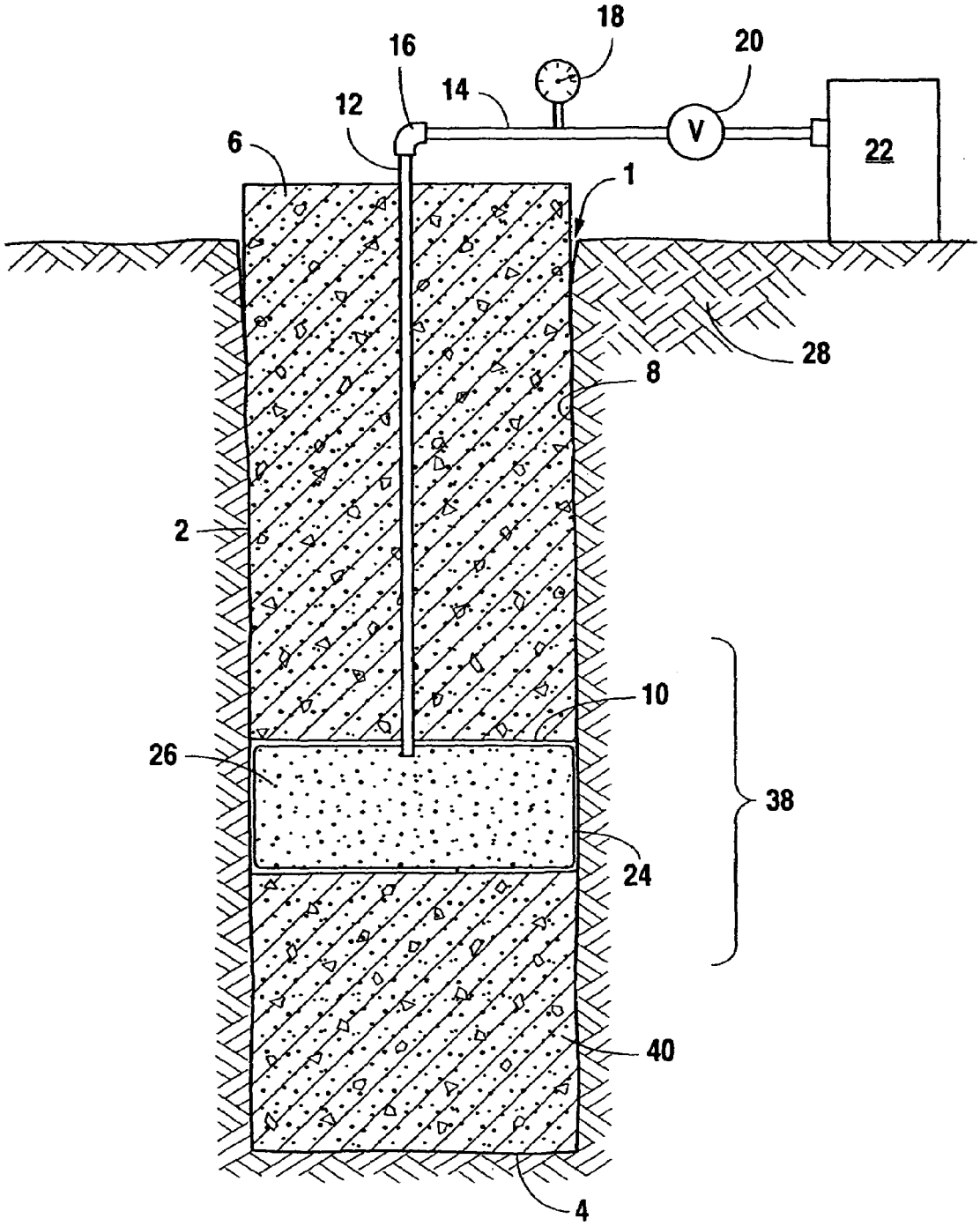
FIG. 4 is a cross-sectional view of another embodiment in which a pier is post-stressed by grout injected intermediate two pier portions along the length of a pier.

An alternative embodiment of a post-stressed pile according to the invention is shown in FIG. 4. In this embodiment, the pier 6 comprises a proximal portion of a pier together with a distal portion 40 within shaft 1. Distal pier portion 40 is formed in conventional fashion in shaft 1. Enclosure 24 is thereafter placed in shaft 1. Pier 6 is formed, resulting in a bisected pier 38. Enclosure 24 is filled with pressurized grout 26 according to the procedures for constructing a continuous post-base-stressed pier given with respect to FIG. 1 hereinabove. In lieu of enclosure 24, pressurized grout may be delivered to bellows 30 as in FIG. 2, or shaft wall 2 and distal pier portion 40 of the bisected pier may be used to contain the pressurized grout beneath lower end 10 of pier 6. A bisected pier configuration according to this embodiment may be selected when, for example, earthen material 28 near the shaft floor 4 is too soft to adequately contain enclosure 24 when filled with pressurized grout 26, and harder ground conditions prevail higher in shaft 1.

While particular embodiments of the invention have been illustrated and described, it will be obvious to those skilled in the art that various changes and modifications may be made without sacrificing the advantages provided by the principles of construction and operation disclosed herein.

What is claimed is:

1. A structural pile assembly with enhanced load bearing capacity for supporting foundations, bridges and other loads, comprising:

a driven pile disposed in the ground and characterized by a weight; and an enclosure positioned beneath said driven pile, said enclosure containing grout hardened under pressure exerted through a conduit and said enclosure exerting an upward force on said driven pile, thereby enhancing the load bearing capacity of said driven pile assembly.

2. The structural pile assembly of claim 1, wherein said upward force exceeds the weight of the driven pile.

3. The structural pile assembly of claim 2, wherein said enclosure comprises a bladder.

4. The structural pile assembly of claim 3, wherein said bladder is rubber.

5. The structural pile assembly of claim 2, wherein said enclosure comprises bellows.

6. The structural pile assembly of claim 5, wherein said bellows comprise upper and lower metal plates.

7. The structural pile assembly of claim 1, wherein said conduit extends axially along the length of said driven pile for delivering said pressurized grout to said enclosure.

8. A structural pile assembly with enhanced load bearing capacity for supporting foundations, bridges and other loads, comprising:

a driven pile disposed in the ground and characterized by a weight; and grout placed beneath said driven pile through a conduit and hardened under pressure exerted through said conduit and said grout exerting an upward force on said pile to enhance the load bearing capacity of said structural pile assembly.

9. The structural pile assembly of claim 8, wherein said upward force exceeds the weight of the driven pile.

10. The structural pile assembly of claim 9, wherein said conduit extends axially along the length of said driven pile for delivering said pressurized grout beneath said driven pile.

11. The structural pile assembly of claim 9, wherein said driven pile has a wall and said pressurized grout does not extend substantially upward alongside the pile wall.

* * * * *